US008075247B2

(12) United States Patent
Romani et al.

(10) Patent No.: US 8,075,247 B2
(45) Date of Patent: Dec. 13, 2011

(54) CENTRIFUGAL IMPELLER WITH INTERNAL HEATING

(75) Inventors: Giuseppe Romani, Mississauga (CA); Xiaoliu Liu, Mississauga (CA); Paul Stone, Guelph (CA); Bruce Fielding, Glen Williams (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1025 days.

(21) Appl. No.: 11/962,758

(22) Filed: Dec. 21, 2007

(65) Prior Publication Data

US 2009/0162190 A1 Jun. 25, 2009

(51) Int. Cl.
*F01D 25/10* (2006.01)

(52) U.S. Cl. ..... 415/58.4; 415/144; 415/176; 415/211.2

(58) Field of Classification Search ..... 415/144, 415/176, 58.4, 211.2; 416/185
See application file for complete search history.

(56) References Cited

U.S. PATENT DOCUMENTS

| | | | | |
|---|---|---|---|---|
| 3,384,345 | A | 5/1968 | Neath et al. | |
| 3,741,676 | A | 6/1973 | Silvern et al. | |
| 3,741,677 | A | 6/1973 | Silvern et al. | |
| 3,834,179 | A | 9/1974 | Eskeli | |
| 3,976,390 | A | 8/1976 | Silvern et al. | |
| 4,117,669 | A | 10/1978 | Heller | |
| 4,264,271 | A | 4/1981 | Libertini | |
| 4,741,153 | A | 5/1988 | Hallinger et al. | |
| 4,793,772 | A * | 12/1988 | Zaehring et al. | 416/95 |
| 4,880,354 | A | 11/1989 | Teranishi et al. | |
| 4,923,370 | A | 5/1990 | Larson et al. | |
| 5,059,091 | A | 10/1991 | Hatfield | |
| 5,271,711 | A | 12/1993 | McGreehan et al. | |
| 5,316,437 | A | 5/1994 | Czachor | |
| 5,351,478 | A | 10/1994 | Walker et al. | |
| 5,472,313 | A | 12/1995 | Quinones et al. | |
| 6,276,896 | B1 * | 8/2001 | Burge et al. | 415/115 |
| 6,935,840 | B2 * | 8/2005 | Romani et al. | 416/95 |
| 7,942,630 | B2 * | 5/2011 | Argaud et al. | 415/144 |

* cited by examiner

*Primary Examiner* — Ninh H Nguyen
(74) *Attorney, Agent, or Firm* — Norton Rose OR LLP

(57) ABSTRACT

An internal heating arrangement for a centrifugal impeller for a gas turbine engine is provided having at least one heating passage extending through into the rotor for directing air bled from the rotor exit along the backface and forwardly through the impeller.

12 Claims, 2 Drawing Sheets

CENTRIFUGAL IMPELLER WITH INTERNAL HEATING

TECHNICAL FIELD

The field of invention relates generally to gas turbine engines and, more particularly, to a way of reducing thermal stresses in a centrifugal impeller of such engines.

BACKGROUND OF THE ART

In order to improve fuel economy of modern gas turbine engines, it is often desirable that the compressor delivery temperature be relatively very high. However, these high compressor delivery temperatures produce even greater thermal gradients between the inner and outer portions of the impellers than in older engines, which correspondingly induce greater thermal stresses in the impellers and have an impact on their low-cycle fatigue (LCF) life.

Accordingly, there is a need to provide a way of mitigating the thermal gradients in centrifugal impellers of gas turbine engines.

SUMMARY

The present concept provides an impeller assembly for a gas turbine engine, the impeller assembly comprising: an impeller rotor having a central bore, a back face, an impeller rotor exit and a radially outer face having a plurality of blades extending therefrom; a bleed apparatus for bleeding compressed air from the impeller rotor exit and delivering said bleed air to the bore along the impeller back face a heating passage extending through at least a portion of the impeller rotor bore, the heating passage having an inlet in fluid communication with bleed air provided to the impeller back face.

The present concept also provides a centrifugal impeller arrangement comprising: an impeller having a central bore; and means for heating a radially inner portion of the impeller with bleed air, wherein said means feeds the bleed air from a back face of the impeller forwardly through the impeller bore.

The present concept further provides a method for reducing thermal stresses in a centrifugal impeller of a gas turbine engine, the method comprising the steps of: a) directing bleed air from the impeller along a back face of the impeller and to a bore of the impeller; and b) directing said bleed air forwardly through the bore to reduce a temperature gradient within the impeller.

Further details of these and other aspects of the concept will be apparent from the detailed description and figures included below.

DESCRIPTION OF THE FIGURES

Reference is now made to the accompanying figures, in which.

DETAILED DESCRIPTION OF THE PREFERRED EMBODIMENTS

Figure 1:
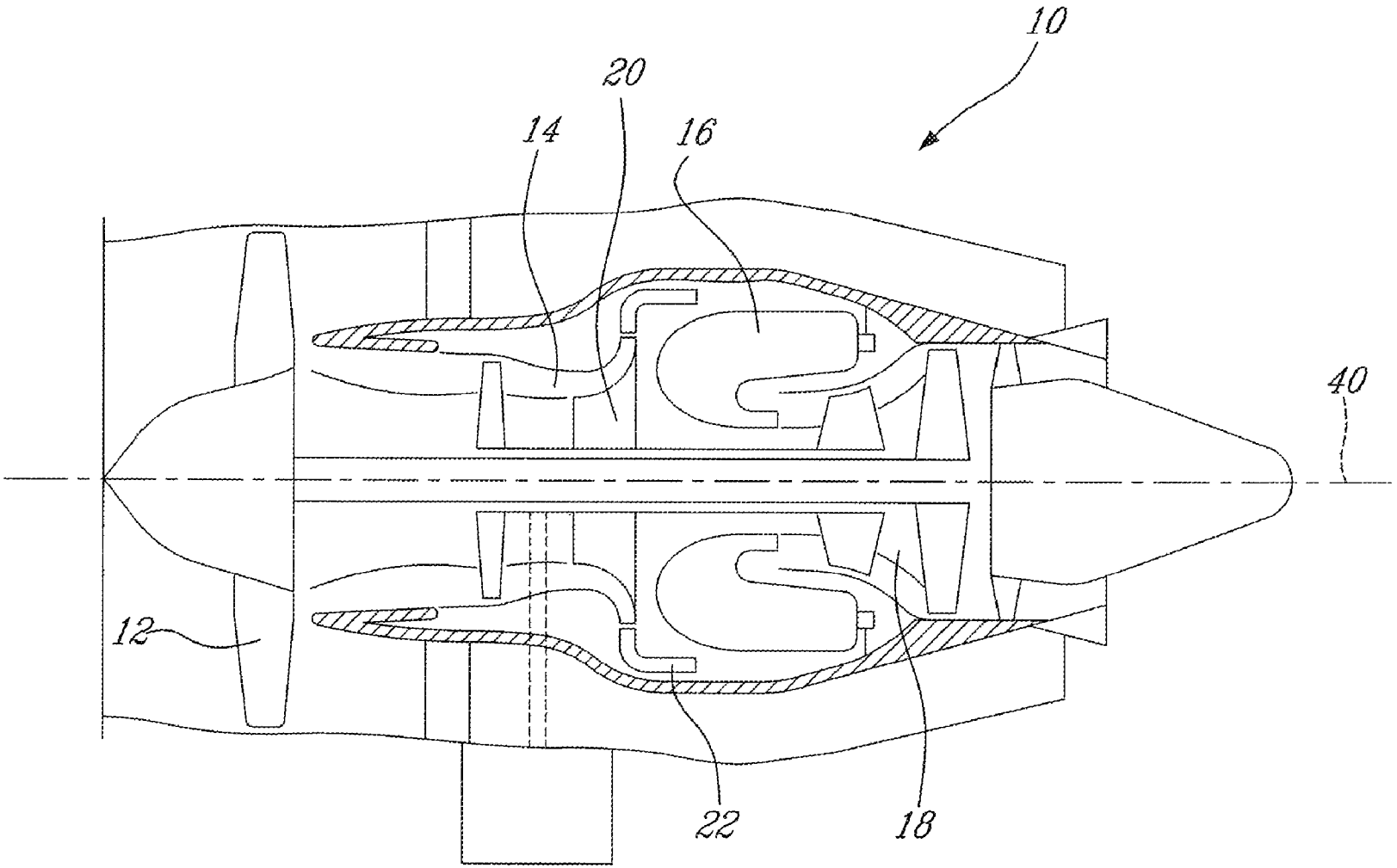
FIG. 1 is a schematic axial cross-section view showing an example of a gas turbine engine.

FIG. 1 illustrates an example of a gas turbine engine 10 of a type provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. FIG. 1 illustrates an example of an environment where the present impeller and method can be used. For instance, the multi-stage compressor 14 comprises a centrifugal impeller 20 which directs the pressurized air into diffuser pipes 22. The present concept is equally applicable to other types of gas turbine engines such as a turbo-shaft, a turbo-prop, or auxiliary power units.

Figure 2:
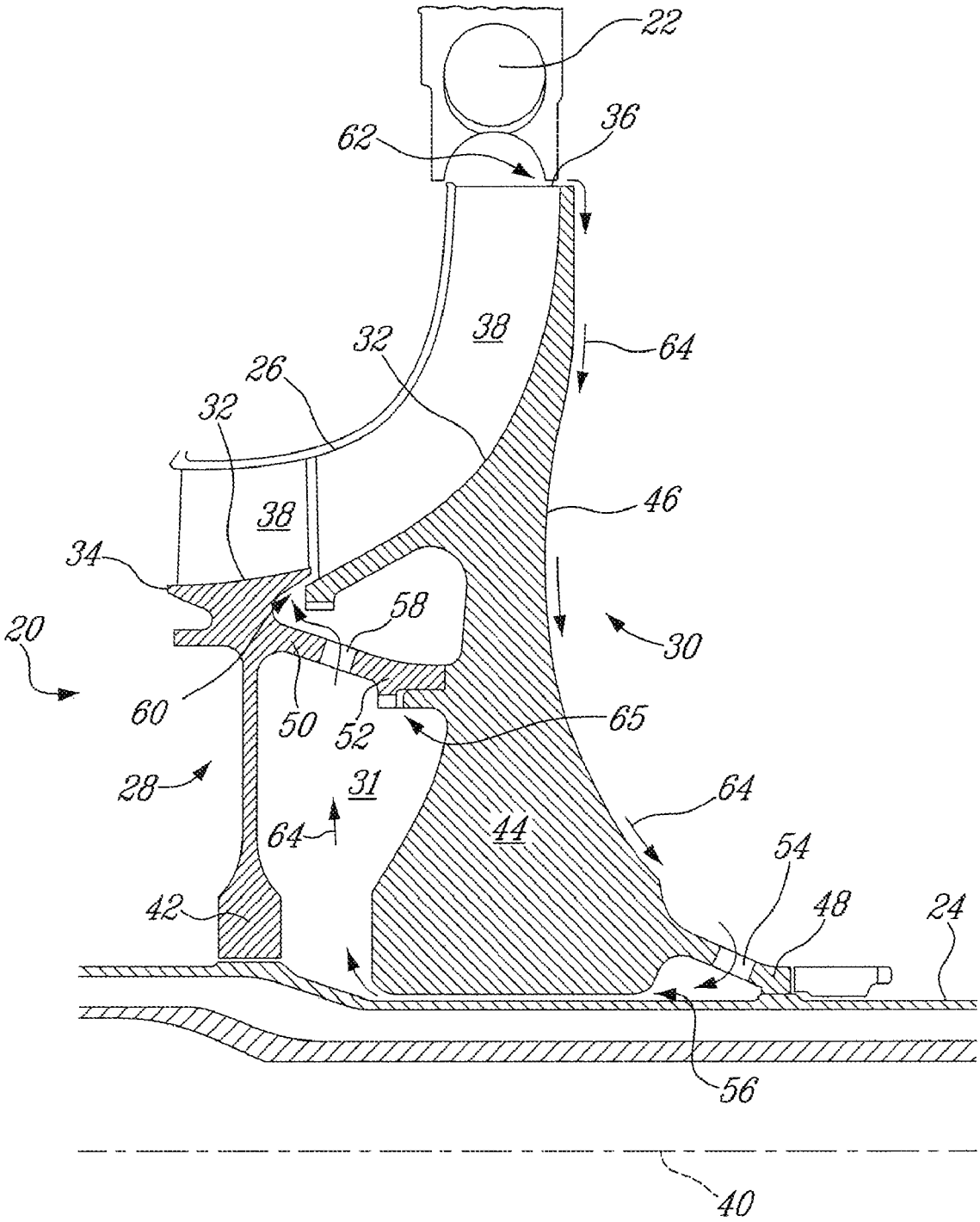
FIG. 2 is a partial axial cross-section view of an example of the present centrifugal impeller.

Referring now to FIG. 2, a cross-section of an example of the present impeller assembly is shown generally at 20. The impeller 20 is supported by and secured to a tie shaft 24. The impeller 20 is housed within a stationary shroud 26. The illustrated impeller 20 has a multi-pieces construction. It is divided in two adjacent pieces, namely an inducer generally shown at 28 and an exducer generally shown at 30, which generally define a central cavity 31 between them. The impeller 20 can be otherwise constructed in one piece.

The impeller 20 comprises a rotor 21. Since the illustrated impeller 20 has two sections 28, 30, both sections 28, 30 define together a radially outer face 32 that is configured and disposed for interfacing with a main stream of gas to be compressed. The outer face 32 has an inlet end 34 and an outlet end 36 between which is defined a main gas path. A plurality of blades 38 are provided around the outer face 32. The blades 38 are disposed axisymmetrically about a central rotation axis 40 of the impeller 20.

The inducer 28 comprises an inducer rotor 42 and the exducer 30 comprises an exducer rotor 44. The inducer rotor 42 and the exducer rotor 44 form the rotor of the impeller 20. The exducer rotor 44 has a back face 46. The exducer rotor 44 is secured to the tie shaft 24 using conventional means via support member 48. The exducer rotor 44 and the inducer rotor 42 are also secured together via connecting member 50 at junction 52. Junction 52 may comprise an arrangement 65 of slots and corresponding dogs which prevent relative rotation between the inducer 28 and the exducer 30 and thereby maintain proper alignment of the blades 38 on the inducer 28 and the exducer 30.

The impeller 20 also comprises a heating passage which extends into the impeller rotor and directs bleed air of hot compressed gas through the exducer rotor 44 in the illustrated example. The heating passage is in fluid communication with the outlet end 36 for directing a portion of the gas being discharged from the outlet end 36 through the exducer rotor 44. The heating passage of the illustrated example comprises a gap 62 which is provided between the impeller 20 and the stationary shroud 26, a first array of holes 54 circumferentially distributed within support member 48, an annular gap generally shown at 56 defined by a central bore extending coaxially with the rotation axis 40 through the exducer rotor 44 and an outer surface of the tie shaft 24, a second array of holes 58 circumferentially distributed within connecting member 50, and, an annular opening generally shown at 60 providing re-circulating fluid communication to the outer face 32. The annular opening 60 is located between the inducer 28 and the exducer 30.

In use, a main stream of gas is received at the inlet end 34 of the rotating impeller 20 and is propelled by the blades 38 along the main gas path on the front face 32. As the gas is propelled towards the outlet end 36, it is compressed and also heated considerably as a result of this compression. The compressed gas is then discharged at the outlet end 36 and subsequently flows through the diffuser pipes 22 before being delivered to the combustor 16, as shown in FIG. 1, or to another compression stage, for instance.

The difference in the temperature between the outer face of the impeller 20 and the radially inner portion of the impeller 20 can result in some internal thermal stresses which, over time, can reduce the lifespan of the impeller 20 by reducing the low-cycle fatigue (LCF) resistance of that part. The present impeller 20 comprises a heating passage provided to redirect bleed air shown by the arrows 64, which stream originates from the hot gas being discharged at full-pressure from the outlet end 36 of the impeller 20. The bleed air can also come from a location upstream of the rotor exit, although the bleed air is only at partial pressure compared to the air pressure immediately downstream of the outlet end 36.

In the illustrated example, the bleed air 64 is channeled to enter the heating passage via the gap 62. The bleed air 64 then proceeds along the back face 46, through the first array of holes 54, through the annular gap 56, through the second array of holes 58, and finally, the hot gas is directed back into the main gas stream via the annular opening 60. The bleed air 64 is induced by the pressure differential that is created between the gas discharged from the outlet end 36 of the impeller 20 and the gas between the inducer 28 and the exducer 30.

As can be appreciated, the hot compressed gas proceeds through the heating passage while heat is transferred to the impeller rotor, especially the exducer rotor 44 where the temperature gradient can otherwise be relatively high between the inner and outer portions thereof. Consequently, the temperature gradient within the exducer rotor 44 is significantly reduced and, in turn, the thermal stresses are also reduced. The temperature gradient across the length of the blades 38 along the main gas path can also be reduced by redirecting the flow of bleed air into the main stream. In use, the redirected gas portion can flow continuously during the entire operation of the gas turbine engine.

The cross-sectional area of the different sections of the heating passage, such as the size of the gap 56 along the bore extending through the exducer rotor 44, are determined based on specific operating conditions, performance requirements and the material properties of the impeller material. Accordingly, conventional modelling and simulation methods commonly used in the art may be used to determine a suitable amount of bleed air required to achieve an acceptable magnitude of thermal stresses within the impeller 20 in order to maintain an acceptable low-cycle fatigue resistance of the impeller 20.

As aforesaid, the impeller shown in FIG. 2 comprises two separate pieces or components that cooperate together, namely the inducer 28 and the exducer 30. The two-piece construction of the impeller 20 further reduces the effects of high thermal gradients within the impeller 20 and also reduces centrifugally-induced stresses in the bore and hub region of the impeller 20. Again, the two-piece impeller construction is not absolutely necessary and similar advantages provided by the heating passage would also be obtained in a single-piece impeller.

The inducer 28 and the exducer 30 may be fabricated out of the same or different materials. The inducer 28 could be fabricated out of a Ti-based alloy while the exducer 30 could be fabricated out of a Ni-based alloy depending on the compressor delivery temperature that is desired. Other materials could be selected for producing an impeller 20 having the desired mechanical properties while at the same time reducing the total weight of the impeller 20, which is also beneficial in improving fuel economy.

The impeller 20 can be manufactured using conventional processes and suitable materials that are able to withstand the exposure to the elevated temperatures of the compressed gas. For example, the impeller 20 can be manufactured using conventional machining or forging techniques or a combination thereof. Advantageously, the two-piece impeller provides for smaller forgings and therefore improved as-forged mechanical properties can be obtained as it is possible to increase the amount of strain working present in the forging in areas that correspond to high stress regions in the finished part.

The above description is meant to be exemplary only, and one skilled in the art will recognize that changes may be made to the embodiments described without departing from the scope of the invention disclosed. For example, many different configurations can be devised for the heating passage, including channels made with the exducer rotor instead of or in addition to the passage through the central bore. The heating passage does not necessarily need to flow along the back face of the exducer rotor. If desired, the bleed air can be vented outside the engine and not recycled back into the main gas stream. It can also be used elsewhere in the engine, for instance to cool a hotter section. The shape of the blades and/or the rotor can be different from what is shown and described. Still other modifications which fall within the scope of the present invention will be apparent to those skilled in the art, in light of a review of this disclosure, and such modifications are intended to fall within the appended claims.

What is claimed is:

1. An impeller assembly for a gas turbine engine, the impeller assembly comprising:

an impeller rotor having a central bore, a back face, an impeller rotor exit and a radially outer face having a plurality of blades extending therefrom;

a bleed apparatus for bleeding compressed air from the impeller rotor exit and delivering said bleed air to the bore along the impeller back face; and a heating passage extending through at least a portion of the impeller rotor bore, the heating passage having an inlet in fluid communication with bleed air provided to the impeller back face.

2. The impeller assembly as defined in claim 1, wherein the heating passage has an outlet in fluid communication with a portion of the impeller axially upstream of the impeller back face relative to a general direction of airflow through the engine.

3. The impeller assembly as defined in claim 1, wherein the impeller rotor comprises an inducer and an exducer, and wherein the heating passage has an outlet feeding a cavity between the inducer and exducer.

4. The impeller assembly as defined in claim 3, wherein the outlet of the heating passage is in fluid communication with a gas path extending between an inlet end and an outlet end of the impeller outer face.

5. A centrifugal impeller arrangement comprising:

an impeller having a central bore; and means for heating a radially inner portion of the impeller with bleed air, wherein said means feeds the bleed air from a back face of the impeller forwardly through the impeller bore.

6. The centrifugal impeller arrangement as defined in claim 5, wherein the means for heating comprise a hot gas passage extending through the impeller bore.

7. The centrifugal impeller arrangement as defined in claim 6, wherein the hot gas passage includes a section through a bore that is coaxial with the rotation axis of the impeller.

8. The centrifugal impeller arrangement as defined in claim 5, wherein the means for heating further comprises means for redirecting the bleed air back into the main gas stream upstream of the impeller backface.

9. The centrifugal impeller arrangement as defined in claim 5, wherein the bleed air re-enters the main gas stream at a mid-point of the impeller.

10. A method for reducing thermal stresses in a centrifugal impeller of a gas turbine engine, the method comprising the steps of:

a) directing bleed air from the impeller along a back face of the impeller and to a bore of the impeller; and b) directing said bleed air forwardly through the bore to reduce a temperature gradient within the impeller.

11. The method as defined in claim 10, wherein the redirected bleed air is provided to a central cavity located between an inducer and an exducer of the impeller.

12. The method as defined in claim 11, wherein the bleed air in the central cavity is directed between the induced and exducer to re-enter a main gas stream flowing through the engine.

* * * * *